US011371705B2

(12) United States Patent
Sadasivuni

(10) Patent No.: US 11,371,705 B2
(45) Date of Patent: Jun. 28, 2022

(54) PILOT BURNER ASSEMBLY WITH PILOT-AIR SUPPLY

(71) Applicant: Siemens Energy Global GmbH & Co. KG, Munich (DE)

(72) Inventor: Suresh Sadasivuni, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 266 days.

(21) Appl. No.: 16/333,410

(22) PCT Filed: Sep. 22, 2017

(86) PCT No.: PCT/EP2017/074082

§ 371 (c)(1),
(2) Date: Mar. 14, 2019

(87) PCT Pub. No.: WO2018/060098

PCT Pub. Date: Apr. 5, 2018

(65) Prior Publication Data

US 2020/0182466 A1 Jun. 11, 2020

(30) Foreign Application Priority Data

Sep. 29, 2016 (EP) ..... 16191296

(51) Int. Cl.
*F23R 3/14* (2006.01)
*F23R 3/26* (2006.01)
(Continued)

(52) U.S. Cl.
CPC ..... *F23R 3/14* (2013.01); *F23R 3/26* (2013.01); *F23R 3/34* (2013.01); *F23R 3/46* (2013.01); *F05D 2240/35* (2013.01)

(58) Field of Classification Search
CPC .... F23R 3/14; F23R 3/20; F23R 3/283; F23R 3/286
See application file for complete search history.

(56) References Cited

U.S. PATENT DOCUMENTS 5,533,329 A 7/1996 Ohyama et al.
6,532,726 B2 3/2003 Norster et al.
(Continued)

FOREIGN PATENT DOCUMENTS

CN 103438480 A 12/2013
CN 204438193 U 7/2015
(Continued)

OTHER PUBLICATIONS

International search report and written opinion dated Dec. 15, 2017 for corresponding PCT/EP2017/074082.

*Primary Examiner* — Arun Goyal

(57) ABSTRACT

A pilot burner assembly for a combustion volume in a gas turbine engine includes a pilot burner, a pilot-fuel supply line, and a pilot-air supply line. The pilot burner has a burner face that includes a plurality of pilot-fuel injection holes. The pilot-fuel injection holes provide a pilot-fuel to the combustion volume. The pilot-fuel supply line is fluidly connected to the pilot-fuel injection holes for supplying the pilot-fuel to the pilot-fuel injection holes. The pilot-air supply line provides a pilot-air to the pilot burner. The pilot-air is supplied to the combustion volume through the burner face. Pilot-air injection holes are located on the burner face and fluidly connected to the pilot-air supply line. The pilot-air injection holes inject the pilot-air into the combustion volume. A gas turbine has the pilot burner assembly.

12 Claims, 9 Drawing Sheets

(51) Int. Cl.
*F23R 3/34* (2006.01)
*F23R 3/46* (2006.01)

(56) References Cited

U.S. PATENT DOCUMENTS

| | | | | |
|---|---|---|---|---|
| 7,669,421 | B2 * | 3/2010 | Saitoh | F23R 3/14 60/748 |
| 8,181,464 | B2 * | 5/2012 | Wilbraham | F23D 14/02 60/748 |
| 9,016,601 | B2 * | 4/2015 | Headland | F23R 3/14 239/399 |
| 9,032,736 | B2 * | 5/2015 | Hase | F23R 3/02 60/737 |
| 9,222,666 | B2 * | 12/2015 | Liu | F23R 3/286 |
| 9,400,113 | B2 * | 7/2016 | Ogata | F23R 3/36 |
| 2005/0144929 | A1 | 7/2005 | Jonsson et al. | |
| 2011/0162371 | A1 | 7/2011 | Khan et al. | |
| 2016/0146460 | A1 | 5/2016 | Stewart et al. | |

FOREIGN PATENT DOCUMENTS

| | | | |
|---|---|---|---|
| EP | 0728989 | A2 | 8/1996 |
| EP | 1835231 | A1 | 9/2007 |
| EP | 2187128 | A1 | 5/2010 |
| EP | 2631544 | A1 | 8/2013 |
| EP | 2754963 | A1 | 7/2014 |
| WO | 03044433 | A1 | 5/2003 |

* cited by examiner

PILOT BURNER ASSEMBLY WITH PILOT-AIR SUPPLY

CROSS REFERENCE TO RELATED APPLICATIONS

This application is the US National Stage of International Application No. PCT/EP2017/074082 filed Sep. 22, 2017, and claims the benefit thereof. The International Application claims the benefit of European Application No. EP16191296 filed Sep. 29, 2016. All of the applications are incorporated by reference herein in their entirety.

FIELD OF INVENTION

The present technique relates generally to burners for combustors of gas turbine engines and, more particularly to pilot burner assemblies having pilot-air supply for combustors of gas turbine engines.

BACKGROUND OF INVENTION

In a gas turbine engine combustor a fuel is combusted or burned to produce hot pressurised exhaust gases which are then fed to a turbine stage where they, while expanding and cooling, transfer momentum to turbine blades thereby imposing a rotational movement on a turbine rotor. Mechanical power of the turbine rotor can then be used to drive a generator for producing electrical power or to drive a machine. However, burning the fuel leads to a number of undesired pollutants in the exhaust gas which can cause damage to the environment. Therefore, it is generally desired to keep the pollutants as low as possible. One kind of pollutant is nitrogen oxide ($NO_X$).

Combustion in present day gas turbine engine combustors, for example Dry Low Emissions (DLE) combustors, is initiated and maintained by using a pilot-fuel and a main-fuel fed at different positions of the combustor and at different stages of operation, for example in some DLE combustors, the percentage split of pilot-fuel is about 4% or more at full load and increases at part load, primarily to prevent combustion dynamics and flame out as the air-to-fuel ratio increases. However, the pilot-fuel tends to burn in a non-premixed and/or partially premixed mode close to the burner face and to generate high levels of thermal $NO_x$. Furthermore, the pilot-fuel being injected into the combustor as a rich fuel, i.e. non-premixed, tends to burn in localized regions of the combustor resulting in burning of rich pockets of fuel that create high temperature regions/pockets, or local hotspots, within the combustor that adversely affect component life within the combustor.

It is therefore desired to provide a technique that reduces emissions, particularly $NO_x$, resulting from combustion of the pilot-fuel in air deficient conditions.

SUMMARY OF INVENTION

Thus, the object of the present disclosure is to provide a technique that ensures possibility of combustion of pilot-fuel in sufficient amounts of air and thus reduces emissions, particularly $NO_x$. It is also desirable that the technique of the present disclosure ensures pre-mixing of the pilot-fuel with air or promotes mixing of the pilot-fuel with air by increasing turbulence in the combustor, especially in the region of the combustor where the pilot-fuel is injected into the combustor.

The above object is achieved by a pilot burner assembly, and a gas turbine engine having at least one such pilot burner assembly of the present technique. Advantageous embodiments of the present technique are provided in dependent claims.

In a first aspect of the present technique, a pilot burner assembly for a combustion volume in a gas turbine engine is presented. The pilot burner assembly includes a pilot burner, a pilot-fuel supply line, and a pilot-air supply line. The pilot burner has a burner face that includes a plurality of pilot-fuel injection holes, hereinafter also referred to as the pilot-fuel holes. The pilot-fuel holes provide a pilot-fuel to the combustion volume, i.e. inject the pilot-fuel into the combustion volume, for combustion. The pilot-fuel supply line is fluidly connected to the pilot-fuel holes. The pilot-fuel supply line provides or supplies the pilot-fuel to the pilot-fuel holes. The pilot-air supply line provides a pilot-air to the pilot burner such that the pilot-air is supplied to the combustion volume through the burner face.

As a result of the introduction of the pilot-air into the combustion volume through the burner face, the pilot-air is injected in that region of the combustion volume where the pilot-fuel injection holes inject the pilot-fuel during operation of the combustor. The pilot-fuel and the pilot-air may be premixed before injection into the combustion volume or may be injected simultaneously, when so desired, within the region of the combustion volume. Thereby ensuring that the pilot-fuel combusts in an ambience having a desired amount of air, in the form of the pilot-air. This results in decrease in emissions and reduces possibility of formation of high temperature regions/pockets or the hotspots within the combustor and thereby preserves structural integrity and enhances component life of combustor components, such as the burner face of the pilot burner.

In an embodiment of the pilot burner assembly, the pilot-air supply line is fluidly connected to the pilot-fuel supply line. The pilot-air supply line provides the pilot-air into the pilot-fuel supply line. The pilot-air then mixes with the pilot-fuel to form a pilot-fuel/pilot-air premix within the pilot-fuel supply line. The pilot-fuel/pilot-air premix is provided to or injected into the combustion volume for combustion via the pilot-fuel holes. This provides an embodiment where the pilot-fuel and the pilot-air may be premixed before being injected into the combustion volume.

In another embodiment, the pilot burner assembly includes a premixing chamber. The premixing chamber is fluidly connected to the pilot-fuel supply line for receiving the pilot-fuel. The premixing chamber is also fluidly connected to the pilot-air supply line for receiving the pilot-air. The pilot-fuel and the pilot-air are mixed within the premixing chamber to form a pilot-fuel/pilot-air premix. The premixing chamber includes an outlet. The outlet is fluidly connected to the pilot-fuel holes which in turn provide the pilot-fuel/pilot-air premix to the combustion volume for combustion. This provides another embodiment where the pilot-fuel and the pilot-air may be premixed before being injected into the combustion volume. Furthermore, since the premixing chamber has bigger volume than the pilot-fuel supply line and the pilot-air supply line, a thorough premixing of the pilot-fuel and the pilot-air in various desired ratios is achievable within the premixing chamber of the present technique.

In a related embodiment of the pilot burner assembly, the premixing chamber is formed within a body of the pilot burner. This provides a compact pilot burner assembly.

In another embodiment of the pilot burner assembly, the burner face, besides the plurality of pilot-fuel holes, also includes a plurality of pilot-air injection holes. The pilot-air injection holes, hereinafter also referred to as the pilot-air holes are fluidly connected to the pilot-air supply line. The pilot-air holes provide or inject the pilot-air into the combustion volume. The pilot-fuel and the pilot-air may be injected simultaneously or successively, when so desired, within the region of the combustion volume. The pilot-air injection is in form of jets of pilot-air. Furthermore the injection of the pilot-air in form of jets helps create turbulence in the injected pilot-fuel and thus better dispersal of the pilot-fuel, and hence homogenization, is attained resulting in further avoidance of high temperature pockets or hot spots in the combustor during combustion of the pilot-fuel.

In another embodiment of the pilot burner assembly, the pilot-fuel holes are arranged on the burner face circumferentially around a longitudinal axis of the pilot burner. In this embodiment, the pilot-air holes are also arranged circumferentially around the longitudinal axis. Thus the pilot-fuel holes and the pilot-air holes may be arranged in various arrangements depending upon a desired position of the pilot flame. The pilot-fuel holes form a circular array and the pilot-air holes also form a circular array, and one of the arrays may be circumscribed within the other. In a related embodiment of the pilot burner assembly, the pilot-fuel holes and the pilot-air holes are congruently arranged around the longitudinal axis. In this embodiment, the pilot-fuel holes and the pilot-air holes are alternately placed on the burner face. Thus, the pilot-fuel holes and the pilot-air holes form a single circular array with alternately placed pilot-fuel holes and pilot-air holes. This provides an arrangement of the pilot-fuel holes and the pilot-air holes beneficial for thorough mixing of the pilot-fuel with the injected pilot-air. This arrangement also promotes homogeneous mixing of the pilot-fuel and the pilot-air, besides facilitating substantially even dispersion of the pilot-fuel in the combustion volume.

In another embodiment of the pilot burner assembly, a size of the pilot-air holes is smaller than a size of the pilot-fuel injection holes. Thus the jets of pilot-air have a higher momentum compared to jets formed by pilot-air injection performed through pilot-air holes that are of same size as the pilot-fuel injection holes, if the pilot-fuel supply line and the pilot-air supply line provide the pilot-fuel and the pilot-air to the pilot-fuel holes and the pilot-air holes, respectively, at the same pressure. This further promotes turbulence in the pilot-fuel injected in the combustion volume.

In another embodiment, the pilot burner assembly includes a lip. The lip is a structure, like a protrusion or a plane, that overhanging axially above an annular region of the burner face such that an annular pocket is formed axially between the burner face and the lip. The annular region of the burner face is positioned radially outward with respect to the longitudinal axis. The pilot-fuel holes and the pilot-air holes are positioned within the annular region of the burner face. The annular pocket acts as a premixing space where the pilot-fuel and the pilot-air are premixed, or at least partially premixed, before combustion of the pilot-fuel occurs in the combustion volume.

In another embodiment, the pilot burner assembly includes a radial swirler. The radial swirler is for generating a swirling mix of a main-fuel and air. The air enters the combustion volume through the swirler. The radial swirler includes an annular base plate and a plurality of swirler vanes. The annular base plate has a radially inner edge. The plurality of swirler vanes are disposed on the annular base plate spaced apart circumferentially and extending radially around the longitudinal axis of the pilot burner. The swirler vanes include radially inner thin ends. The radially inner thin ends are set back from the radially inner edge of the annular base plate thereby to define an annular ledge on the annular base plate immediately radially outward of the radially inner edge of the annular base plate. The annular ledge on the annular base plate forms the lip. This provides a compact arrangement of the pilot burner assembly.

In another embodiment, the pilot burner assembly includes a pilot-air valve. The pilot-air valve controls a flow of the pilot-air in the pilot-air supply line towards the pilot burner. Thus the pilot-air may be provided to the combustion volume if and when is so desired. Furthermore, amount or rate of the pilot-air provided to the combustion volume may be regulated. The pilot-air may also be completely stopped from being provided to the combustion volume, if and when is so desired.

In another embodiment, the pilot burner assembly includes a control unit. The control unit directs the pilot-air valve to control the flow of the pilot-air in the pilot-air supply line towards the pilot burner such that the pilot-fuel and the pilot-air are provided to the combustion volume in a desired ratio of the pilot-fuel and the pilot-air. The control unit may either, calculate and implement (based on other operational characteristics for example, but not limited to, burner surface temperatures, combustion chamber pressure, etc), or may simply implement (based on pre-stored or pre-existing instructions or directly received instructions or commands from an operator of the control unit) the desired ratio of the pilot-fuel and the pilot-air.

In a second aspect of the present technique, a gas turbine engine is presented. The gas turbine engine includes at least one pilot burner assembly according to the aforementioned aspect of the present technique. The gas turbine engine has same advantages as the aforementioned advantages provided in reference to the first aspect of the present technique.

The gas turbine engine may further comprise a radial swirler having main-fuel injection holes for injecting a main fuel flow. The radial swirler comprises an annular array of swirler vanes arranged circumferentially spaced around an annular base plate so as to form, between adjacent swirler vanes, slots. The pilot burner assembly is generally surrounded by the radial swirler.

The pilot burner assembly injects pilot fuel into the pre-chamber and then main chamber of the combustor system. A pilot flame is produced in the main chamber. The pilot burner assembly is generally surrounded by the radial swirler which injects a main fuel into a main airstream to form a main fuel/air mixture that passes into the pre-chamber and then main chamber of the combustor system. A main flame is produced in the main chamber and which generally surrounds, at least to an extent, the pilot flame. The swirler has a central axis and comprises an annular array of vanes positioned on an base plate and extending around the central axis; an annular closing plate is located atop the annular array of vanes. A plurality of mixing channels or slots is formed by the annular array of vanes, the base plate and the annular closing plate for mixing the fuel and the air.

The plurality of mixing channels is arranged to direct the air (and then air and fuel mixture) in a radially inward direction with respect to the central axis. The plurality of mixing channels or slots is further arranged to direct the air (and then an air and fuel mixture) in a tangential and inward direction with respect to the central axis. Thus the air and fuel mixture is caused to swirl about the central axis and away from the base plate. The plurality of mixing channels is further arranged to direct the air (and then the air and fuel mixture) parallel to the surface of the base plate while it is passing through the mixing channels.

All previously explained configurations may apply to pilot burners and combustor assemblies with gaseous or liquid fuel operation, or with dual fuel operation. Furthermore, the pilot burner may comprise one or more fuel injection openings differently positioned and in addition to the pilot-fuel injection holes of the present disclosure.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

DETAILED DESCRIPTION OF INVENTION

Figure 1:
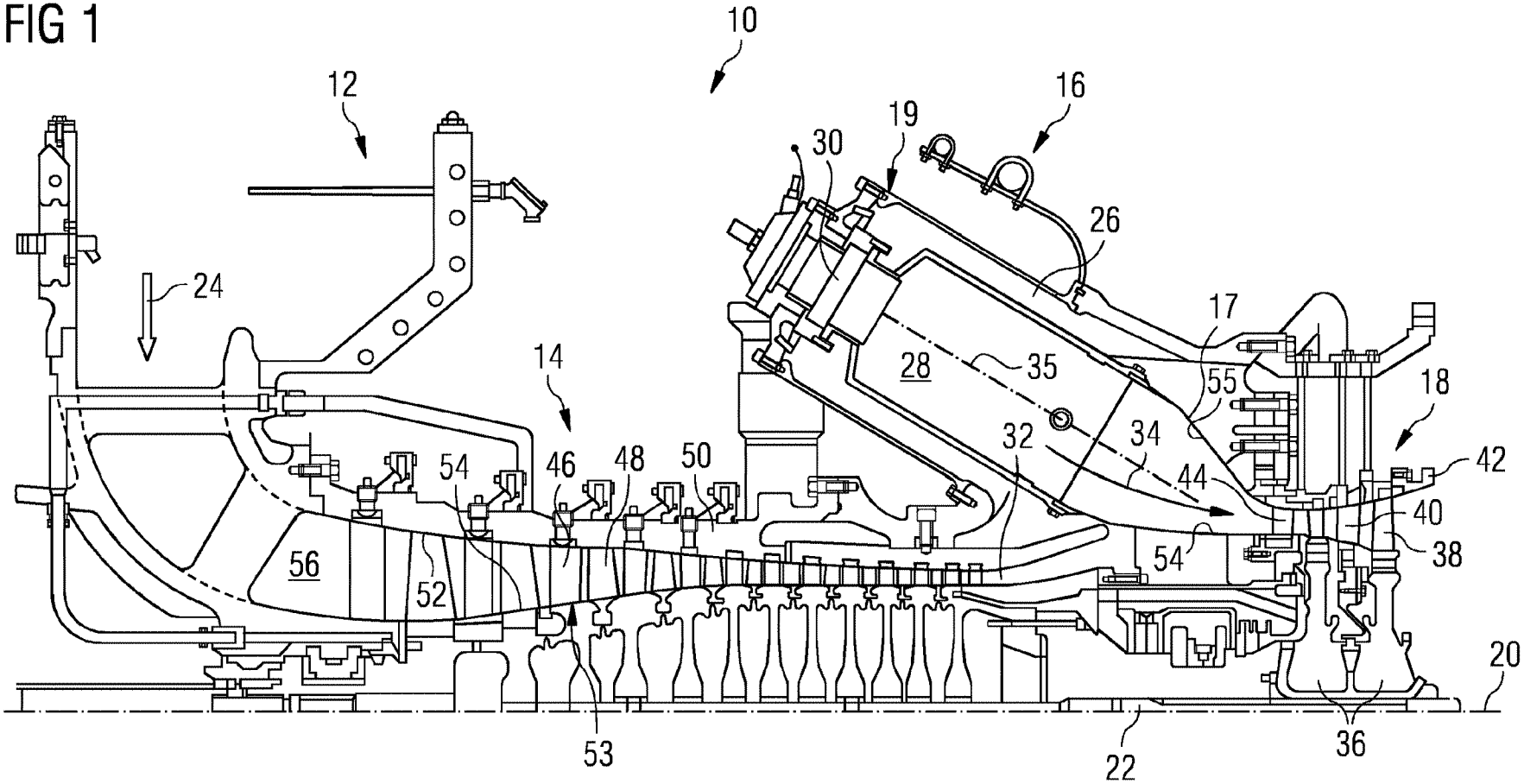
FIG. 1 shows part of a gas turbine engine in a sectional view and in which an exemplary embodiment of a pilot burner assembly of the present technique is incorporated.

Hereinafter, above-mentioned and other features of the present technique are described in details. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

FIG. 1 shows an example of a gas turbine engine 10 in a sectional view. The gas turbine engine 10 comprises, in flow series, an inlet 12, a compressor or compressor section 14, a combustor section 16 and a turbine section 18 which are generally arranged in flow series and generally about and in the direction of a rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The combustor section 16, also referred to as the burner section 16 comprises a burner plenum 26, a combustion volume 28 extending along a longitudinal axis 35 and at least one pilot burner 30 fixed to the combustion volume 28. The combustion volume 28, i.e. the space enclosed by the combustor chamber 99 and optionally by the pre-chamber 88 (shown in FIG. 6 that represents a further detailed view of a combustor 100 in the combustion section 16), and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channeled through the combustion volume 28 to the turbine section 18 via a transition duct 17.

This exemplary gas turbine engine 10 has a cannular combustor section arrangement 16, which is constituted by an annular array of combustor cans 19 each having the burner 30 and the combustion volume 28, the transition duct 17 has a generally circular inlet that interfaces with the combustor chamber 99 (of FIG. 6) and an outlet in the form of an annular segment. An annular array of transition duct outlets form an annulus for channeling the combustion gases 34 to the turbine section 18.

The turbine section 18 comprises a number of blade carrying discs 36 attached to the shaft 22. In the present example, two discs 36 each carry an annular array of turbine blades 38 are shown. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion volume 28 and the leading turbine blades 38 inlet guiding vanes 44 are provided and turn the flow of working gas onto the turbine blades 38.

The combustion gas 34 from the combustion volume 28 enters the turbine section 18 and drives the turbine blades 38 which in turn rotate the rotor. The guiding vanes 40, 44 serve to optimise the angle of the combustion or working gas 34 on the turbine blades 38.

The turbine section 18 drives the compressor section 14. The compressor section 14 comprises an axial series of vane stages 46 and rotor blade stages 48. The compressor section 14 also comprises a casing 50 that surrounds the rotor stages and supports the vane stages 46. The guide vane stages include an annular array of radially extending vanes that are mounted to the casing 50. The casing 50 defines a radially outer surface 52 of the passage 56 of the compressor 14. A radially inner surface 54 of the passage 56 is at least partly defined by a rotor drum 53 of the rotor which is partly defined by the annular array of rotor blade stages 48.

The present technique is described with reference to the above exemplary turbine engine having a single shaft or spool connecting a single, multi-stage compressor and a single, one or more stage turbine. However, it should be appreciated that the present technique is equally applicable to two or three shaft engines and which can be used for industrial, aero or marine applications. Furthermore, the cannular combustor section arrangement 16 is also used for exemplary purposes and it should be appreciated that the present technique is equally applicable to annular type and can type combustors.

The terms axial, radial and circumferential as used hereinabove in reference to FIG. 1 are made with reference to the rotational axis 20 of the engine 10, unless otherwise stated. The terms axial, radial and circumferential as used hereinafter, and with respect to the other FIGS. besides FIG. 1, are made with reference to a longitudinal axis 9 (shown in FIG. 6) of the pilot burner 30, unless otherwise stated.

Figure 2:
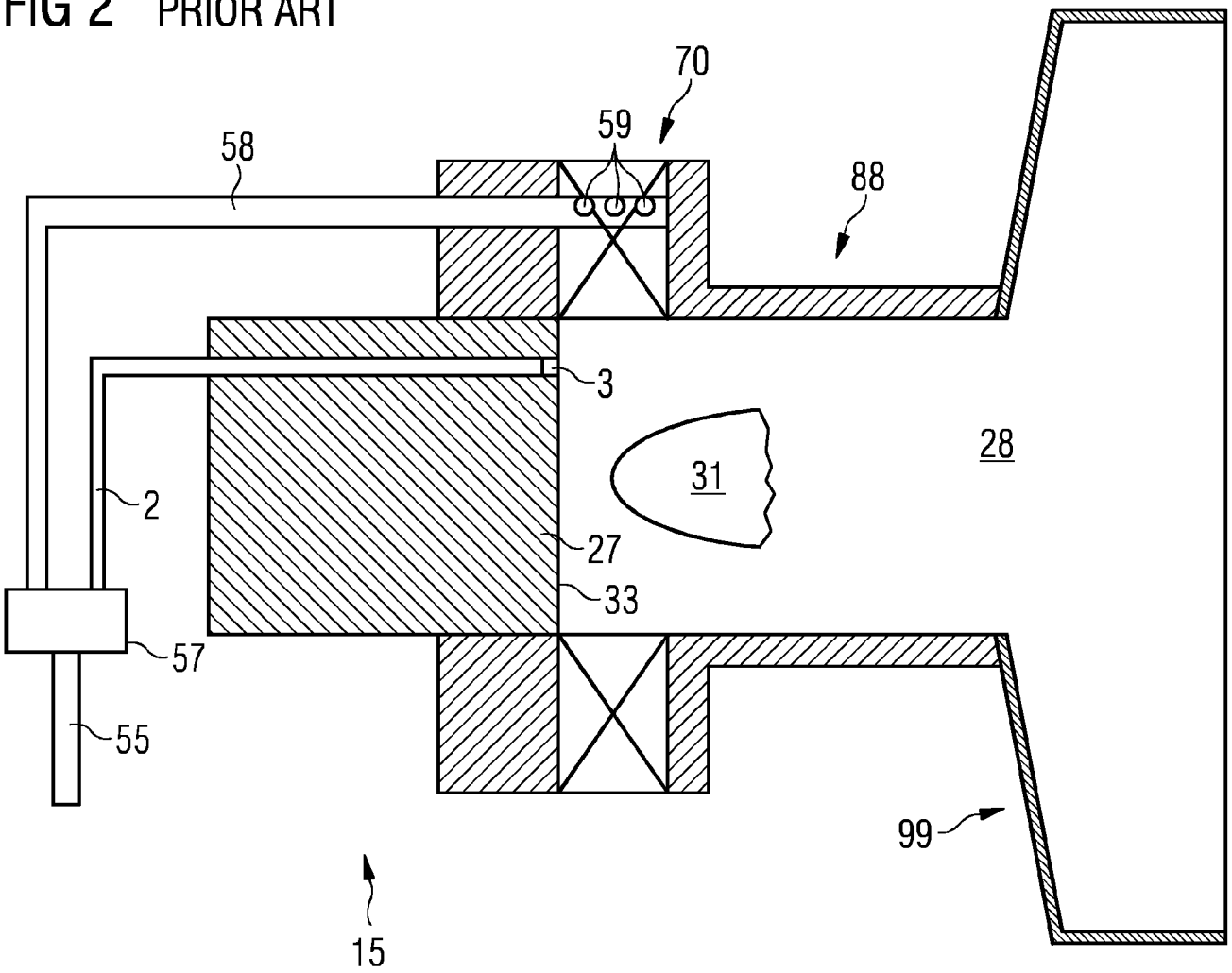
FIG 2 PRIOR ART
FIG. 2 schematically illustrates a sectional view of a conventionally known burner assembly that is different from the pilot burner assembly of the present technique.

The present technique presents a pilot burner assembly 1 (not shown in FIGS. 1 and 2, shown in later FIGS.) that is incorporated in a gas turbine engine, such as the gas turbine engine 10 of FIG. 1. Before explaining details of the pilot burner assembly 1 of the present technique, it will be beneficial for understanding of the present technique if we briefly look at a conventionally known burner assembly 15 as shown schematically in FIG. 2.

Part of a typical conventionally known burner assembly 15 schematically shown in FIG. 2 has a conventional burner 27 having a burner surface 33, a swirler 70, and the combustion volume 28 generally formed from a burner pre-chamber 88 and a combustion chamber 99. Main-fuel is introduced into the swirler 70 by way of a main-fuel supply line 58, while pilot-fuel enters the combustion volume 28 through the burner 27, particularly though pilot-fuel injection holes 3 located on the burner face 33, also referred to as the burner surface 33 through a conduit 2 called as pilot-fuel supply line 2. The main-fuel supply line 58 and the pilot-fuel supply line 2 are derived from a fuel-split valve 57, which is fed with a fuel supply 55 representing a total fuel supply (the main-fuel and the pilot-fuel supplies) to the conventionally known burner assembly 15.

The main-fuel via the main-fuel supply line 58 enters the swirler 70 and is ejected out of a set of main-fuel nozzles (or injector) 59, from where the main-fuel is guided along swirler vanes (not shown), being mixed with incoming compressed air in the process. The resulting swirler-air/main-fuel mixture maintains a burner flame 31. The hot gases from this flame 31 are released in the combustion volume 28. As is shown in FIG. 2, the air that is supplied to the conventionally known burner assembly 15 is via the swirler 70 and mixed with the main-fuel supplied via the main-fuel nozzles 59. In the conventionally known burner 27 or the conventionally known burner assembly 15 there is no provision or function of any air supplied through the burner face 33, either premixed with the pilot-fuel or injected into the combustion volume 28 simultaneously and adjacently with the pilot-fuel. The present technique in contrast introduces pilot-air, as shown in exemplary embodiments of FIGS. 3 to 5.

Figure 3:
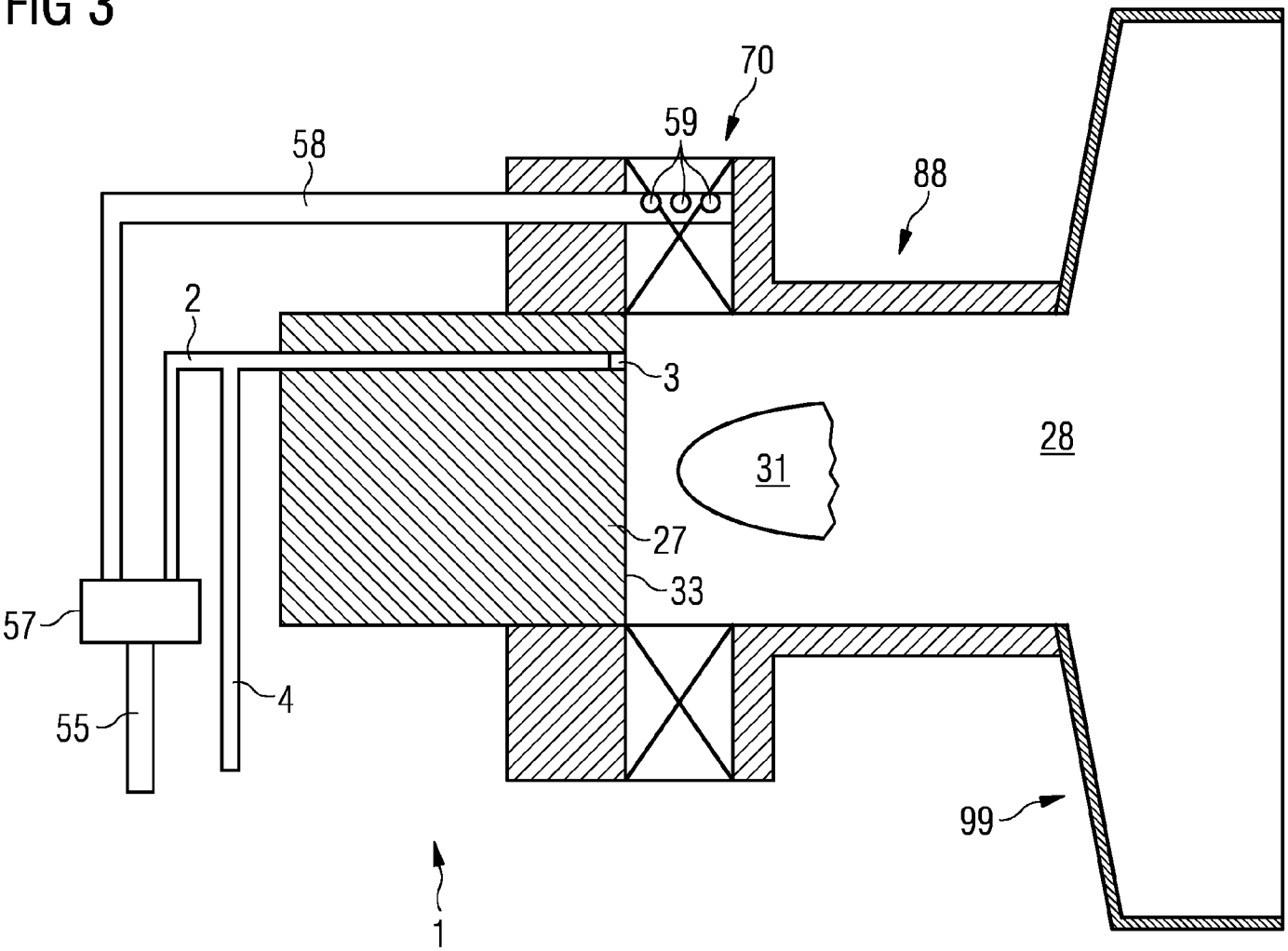
FIG. 3 schematically illustrates an exemplary embodiment of the pilot burner assembly of the present technique.
Figure 4:
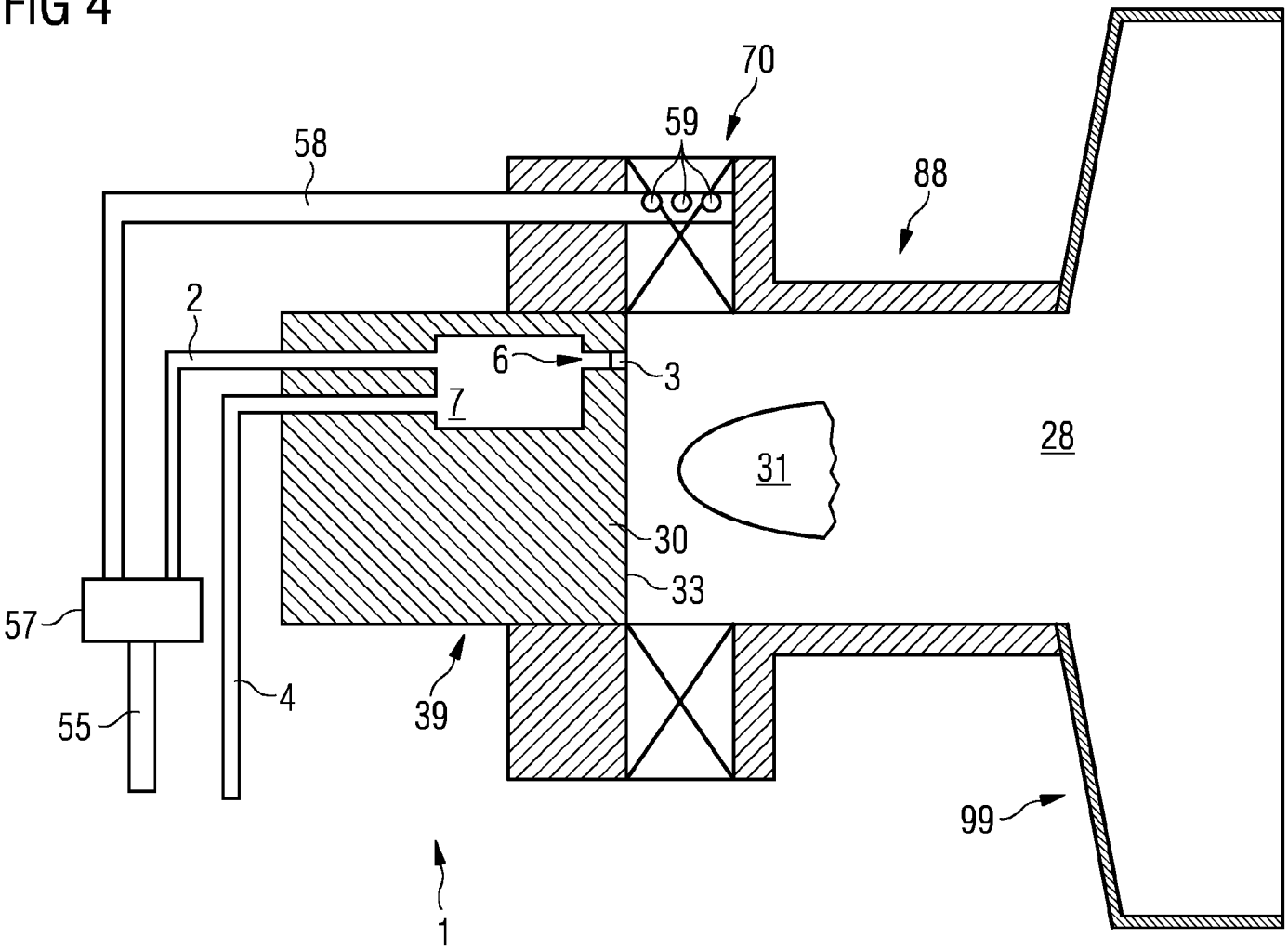
FIG. 4 schematically illustrates another exemplary embodiment of the pilot burner assembly of the present technique.
Figure 5:
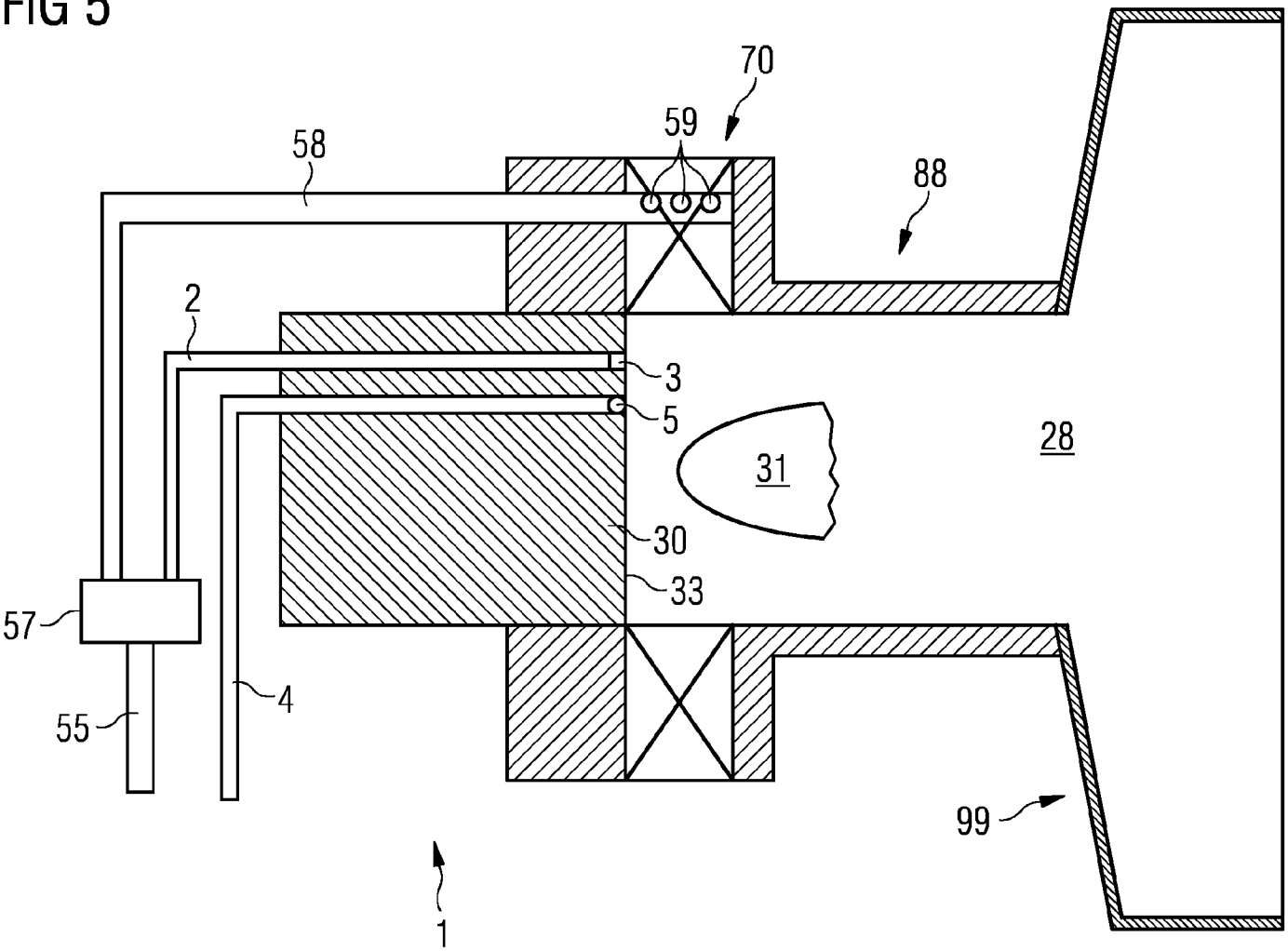
FIG. 5 schematically illustrates yet another exemplary embodiment of the pilot burner assembly of the present technique.

FIG. 3, FIG. 4 and FIG. 5 schematically represent different exemplary embodiments of a pilot burner assembly 1 according to aspects of the present technique. The pilot burner assembly 1, hereinafter also referred to as the burner assembly 1, is associated or arranged with the combustion volume 28 in the gas turbine engine 10 (shown in FIG. 1). The burner assembly 1 includes a pilot burner 30, a pilot-fuel supply line 2 and a pilot-air supply line 4. The pilot burner 30 has a burner face 33. The burner face 33 includes a plurality of pilot-fuel injection holes 3. Only one such pilot-fuel injection hole 3 is shown in FIGS. 3 to 5 for sake of simplicity, however later FIGS. 7 to 10 present the plurality of pilot-fuel injection holes 3. The pilot-fuel injection hole 3 provides, i.e. injects, a pilot-fuel to the combustion volume 28 for combustion. The pilot-fuel supply line 2 is fluidly connected to the pilot-fuel injection holes 3. The pilot-fuel supply line 2 provides the pilot-fuel to the pilot-fuel injection holes 3. The pilot-air supply line 4 provides a pilot-air to the pilot burner 30 such that the pilot-air is supplied to the combustion volume 28 through the burner face 33.

The burner assembly 1 of the present technique makes use of a novel concept of using pilot-air which is introduced in the combustion volume 28, either premixed with the pilot-fuel or partially pre-mixed with the pilot-fuel or injected through a burner face 33 from one or more separate injection holes, referred to as pilot-air injection holes 5 (shown in FIG. 5) immediately next to the pilot-fuel injection holes 3. In a conventionally known burner assembly 15, as shown in FIG. 2, air is supplied through the swirler 70 and primarily mixed with the main-fuel to form the premix combustible reactants having the main-fuel and air. In conventionally known burner assembly 15 generally no air is supplied as the pilot-air and therefore no pilot-air is used.

The term 'pilot-air' as used in the present disclosure means air that is introduced along with the pilot-fuel, and may not include air introduced through swirler 70 (as shown in FIG. 2) or air introduced through other air inlets associated with a main burner or combustion chamber. Furthermore, the term 'pilot-air' includes, but not limited to, air introduced through a burner face/surface or head of the burner assembly 1, for example, 'pilot-air' is the air introduced through the burner face 33 that has one or more pilot-fuel injection holes 5 (shown in FIG. 5).

For example, as shown in FIG. 5, the 'pilot-air' is air introduced through the burner face 33 that has one or more pilot-fuel injection holes 3 (through which pilot-fuel is introduced) and one or more novel pilot-air injection holes 5, through which air, i.e. pilot-air, is introduced and wherein the pilot-fuel injection holes 3 and the pilot-air injection holes 5 are present on the same surface of the burner face 33. Yet another example of the 'pilot-air' is the air that is premixed with the pilot-fuel, and then the mix of the pilot-fuel and the pilot-air, i.e. the premixed pilot-fuel and pilot-air is introduced through one or more openings into the combustion volume 28, as shown in FIGS. 3 and 4.

The burner assembly 1 having the combustion volume 28, i.e. seat of combustion, includes the burner 30 having the burner face 33 which is face or surface of the burner 30 that is contiguous with and facing the combustion volume 28. The combustion volume 28 is formed by space circumferentially enclosed, with respect to the axis 35 shown in FIG. 1, by the burner pre-chamber 88 and the combustion chamber 99. Similar to FIG. 2, the burner 30 may includes main-fuel supply line 58 for introducing the main-fuel into the swirler 70 through the main-fuel nozzles 59. The main-fuel supply line 58 and the pilot-fuel supply line 2 are fed by the fuel supply 55, representing the total fuel supply to the burner assembly 1, and their respective ratios (the pilot-fuel to the main-fuel) at different load levels of operation of the burner assembly 1 are controlled by the fuel-split valve 57. The fuel-split valve 57 is well known and thus not described herein in further detail for sake of brevity. The fuel-split valve 57 is generally controlled by an engine control unit (not shown in FIGS. 3 to 5, but presented later as control unit 90 in FIG. 12) which instructs the fuel-split valve 57 to split the total fuel at a given load level to the pilot-fuel supplied to the burner 30 via the pilot-fuel holes 3 and to the main-fuel injected into the combustion volume 28 via the main-fuel nozzles 59. The split is performed, under the instructions of the engine control unit, either abiding by a default split map or by calculated/adjusted split as achieved from a monitoring and control technique.

Referring now to FIG. 3, an exemplary embodiment of the burner assembly 1 has been explained in further details. In the embodiment of the burner assembly 1 shown in FIG. 3 the pilot-air supply line 4 is fluidly connected to the pilot-fuel supply line 2. The pilot-air supply line 4 thus provides the pilot-air into the pilot-fuel supply line 2. When the pilot-air is supplied into the pilot-fuel flowing in the pilot-fuel supply line 2 towards the pilot burner 30, the pilot-air is mixed with the pilot-fuel within the pilot-fuel supply line 2 and this forms a pilot-fuel/pilot-air premix within the pilot-fuel supply line 2. The pilot-fuel/pilot-air premix so formed is provided, i.e. ejected out of the burner surface 33, or in other words injected into the combustion volume 28, by the pilot-fuel injection holes 3.

Referring now to FIG. 4, another exemplary embodiment of the burner assembly 1 has been explained in further details. As shown in FIG. 4, in another embodiment of the burner assembly 1, the pilot-fuel is supplied, via the pilot-fuel supply line 2, through the burner 30 and into a premixing chamber 7 formed in the burner 30. The pilot-air supply line 4 also connects to, and thus supplies, the premixing chamber 7 with the pilot-air. In the embodiment of the burner assembly 1 shown in FIG. 4, the premixing chamber 7 is formed within or limited within a body 39 of the burner 30. Alternatively, in another embodiment (not shown), the premixing chamber 7 may be formed outside the body 39 of the burner 30, i.e. not limited within the body 39 of the burner 30.

The pilot-air, if and when supplied to the premixing chamber 7, mixes with the pilot-fuel to form mix of the pilot-fuel and the pilot-air, i.e. the pilot-air is pre-mixed with pilot-fuel before being supplied to the combustion volume 28. The premixing chamber 7 has an outlet 6 that is fluidly connected to the pilot-fuel injection holes 3. Therefore, the pilot-air, if and when supplied to the premixing chamber 7, mixes with the pilot-fuel to form the mix of the pilot-fuel and the pilot-air, that is the pilot-fuel is pre-mixed with pilot-air before being injected out of the pilot-fuel injection holes 3. As aforementioned, although FIG. 4 (and also FIGS. 3, 5 and 12) shows only one pilot-fuel injection hole 3, it may be noted that a plurality of pilot-fuel injection hole 3 are generally present on the burner face 33, as shown in FIGS. 7 to 10.

In this embodiment of the burner assembly 1, the pilot-fuel and the pilot-air may be mixed in the premixing chamber 7 in any desired ratio, for example if no pilot-air is provided to the premixing chamber 7 but only pilot-fuel is supplied, then the outlet 6, via the pilot-fuel holes 3, is capable of providing to the combustion volume 28 only the pilot-fuel i.e. only the pilot-fuel is injected out of the pilot-fuel injection holes 3 without the pilot-air. On the other hand the pilot-fuel and the pilot-air may be mixed in the premixing chamber 7 in equal amounts, and then a desired ratio of 1:1 is achieved and then the outlet 6 is capable of providing to the combustion volume 28, via the pilot-fuel holes 3, a premixed pilot-fuel having equal amount of the pilot-air, injected out of the pilot-fuel injection holes 3. Similarly, the pilot-fuel and the pilot-air may be mixed in the premixing chamber 7 in 3:1 ratio, and then the outlet 6 is capable of providing to the combustion volume 28, via the pilot-fuel holes 3, the premixed pilot-fuel having 75% pilot-fuel mixed with 25% pilot-air, injected out of the pilot-fuel injection holes 3.

Figure 10:
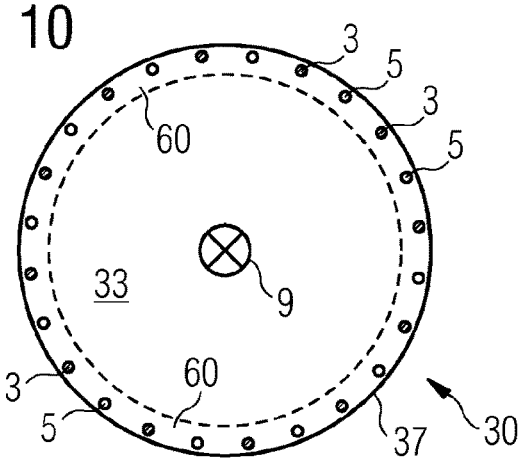
FIG. 10 schematically illustrates a burner face depicting an arrangement of pilot-fuel injection holes and pilot-air injection holes in an exemplary embodiment of the pilot burner assembly of the present technique.

Referring now to FIG. 5, yet another exemplary embodiment of the burner assembly 1 has been explained in further details. As shown in FIG. 5, the pilot-fuel is supplied, via the pilot-fuel injection line 2, through the burner 30 i.e. through the burner face 33 and into the combustion volume 28 injected through the pilot-fuel injection holes 3. As depicted in FIG. 5, the burner face 33 besides having the pilot-fuel holes 3 also has a plurality of pilot-air injection holes 5 (the plurality is shown schematically in FIG. 10 which represents the burner face 33 and shows a plurality of alternately arranged pilot-fuel holes 3 and the pilot-air injection holes 5). Although one pilot-air injection hole 5, hereinafter also referred to as the pilot-air hole 5, is shown in FIG. 5, generally on the burner face 33 or the burner surface 33, a plurality of pilot-fuel holes 3 and a plurality of pilot-air holes 5 are present as shown in FIG. 10. In this embodiment of the burner assembly 1, each pilot-fuel hole 3 is fluidly connected to the pilot-fuel supply line 2 and each pilot-air hole 5 is fluidly connected to the pilot-air supply line 4. The pilot-air and the pilot-fuel are both capable of being injected into the combustion volume 28, particularly through the burner surface 33, independently of each other, either successively or simultaneously.

In this embodiment of the burner assembly 1, the pilot-fuel and the pilot-air may be successively or simultaneously provided to the combustion volume 28 in any desired ratio, for example if no pilot-air is provided though the pilot-air holes 5 but only pilot-fuel is supplied though the pilot-fuel holes 3, then the combustion volume 28 receives only pilot-fuel i.e. rich pilot-fuel. On the other hand when the pilot-fuel and the pilot-air are provided simultaneously from the pilot-fuel holes 3 and the pilot-air holes 5 at equal rates, then a desired ratio of 1:1 is achieved in the combustion volume 28. Similarly, when the pilot-fuel is provided from the pilot-fuel holes 3 at a rate that is three times a rate of simultaneously provided pilot-air from the pilot-air holes 5, then a desired ratio of 3:1 is achieved in the combustion volume 28.

FIG. 10 shows an arrangement of the pilot-fuel holes 3 and the pilot-air holes 5 on the burner face 33 of the burner 30 in an exemplary of the burner assembly 1. The pilot-fuel holes 3 are arranged on the burner face 33 circumferentially around a longitudinal axis 9 of the pilot burner 30. The pilot-air holes 5 are also arranged on the burner face 33 circumferentially around the longitudinal axis 9 of the pilot burner 30. As shown in the embodiment of the burner assembly 1 of FIG. 10, the pilot-fuel holes 3 and the pilot-air holes 5 are concentrically arranged, particularly congruently in the embodiment of FIG. 10, around the longitudinal axis 9. The pilot-fuel holes 3 and the pilot-air holes 5 are alternately placed on the burner face 33. In another embodiment (not shown) of the burner assembly 1, the pilot-fuel holes 3 and the pilot-air holes 5 are concentrically arranged, but non-congruently, around the longitudinal axis 9 and thus forming two distinct circular arrays.

In an exemplary embodiment of the burner assembly 1, a size of the pilot-air holes 5 is smaller than a size of the pilot-fuel holes 3, for example a diameter of the pilot-air holes 5 is smaller than a diameter of the pilot-fuel holes 3. With smaller diameter of the pilot-air holes 5, the ejected pilot-air in form of jets will have more momentum even if the pressure at which pilot-air is supplied to the pilot-air holes 5 is same as the pressure at which the pilot-fuel is supplied to the pilot-fuel holes 3. For example the size of the pilot-air holes 5 is between 50% and 70% of the size of the pilot-fuel holes 3.

Hereinafter FIGS. 6 to 11 are referred to describe various embodiments of the burner assembly 1.

Figure 9:
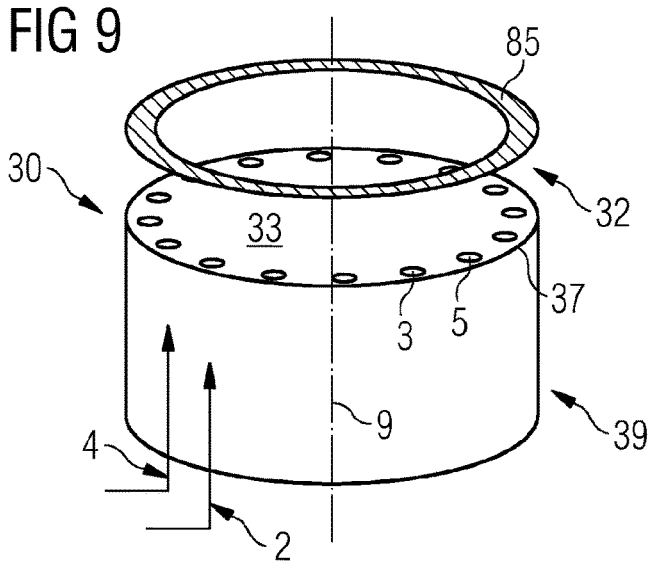
FIG. 9 schematically illustrates an exploded view of an exemplary embodiment of a part of the pilot burner assembly of the present technique showing a lip.
Figure 11:
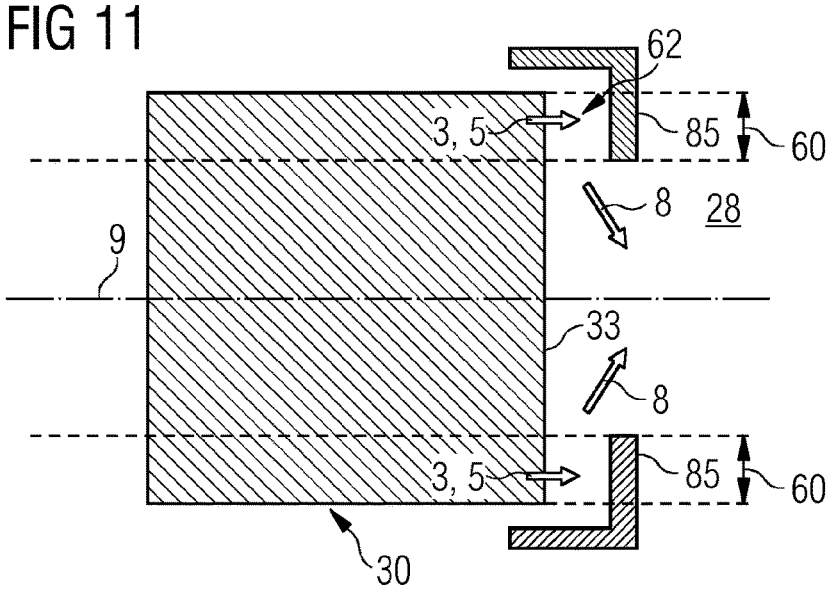
FIG. 11 depicts a schematic cross-section of the pilot burner of FIG. 9 and showing the lip of FIG. 9.

As shown in FIGS. 10 and 11, in one or more embodiments the burner face 33 of the pilot burner 30 has an annular region 60. The annular region 60 is generally located peripherally immediately inwards of an outer circular edge 37 of the burner face 33 and radially outwards from the longitudinal axis 9. The pilot-fuel holes 3 and the pilot-air holes 5 are limited within or positioned within the annular region 60, advantageously in alternating pattern as shown in FIG. 10. The burner assembly 1 includes a lip 85, as shown in FIGS. 9 and 11, overhanging axially, i.e. with respect to the longitudinal axis 9 of the pilot burner 30, above the annular region 60 of the burner face 33. The lip 85 may be understood as an annular surface positioned on top of the annular region 60 and axially distanced. In other words, the lip 85 and the annular region 60, and thus the burner surface 33 on which the annular region 60 is, are parallelly disposed and are both normal to the longitudinal axis 9 of the pilot burner 30. As a result of axially spaced apart arrangement of the lip 85 above the annular region 60 of the burner surface 33, an annular pocket 62 is formed axially between the burner face 33 and the lip 85, more precisely between the annular region 60 and the lip 85. The annular pocket 62 opens radially inwards, i.e. towards the longitudinal axis 9, as shown in FIG. 11. The pilot-fuel and the pilot-air when simultaneously ejected out of the pilot-fuel holes 3 and the pilot-air holes 5 are ejected in the annular pocket 62, as shown by the arrow labelled with reference numerals 3, 5 in FIG. 11. As a result the pilot-fuel and the pilot-air are partially pre-mixed in the annular pocket 62 before the pilot-fuel and the pilot-air in their partially premixed state flow out of the annular pocket 62 in a flow direction represented by arrows marked with reference numeral 8 in FIG. 11. The injection of the pilot-air may also be successively performed after the injection of the pilot-fuel, and the partial premixing may also be achieved this way. The injection of the pilot-air simultaneously with or successively after injection of the pilot-fuel induces and/or increases turbulence in the pilot-fuel.

Hereinafter embodiments of the burner assembly 1, with more details of the lip 85, are explained with reference to FIGS. 6 to 8, in combination with FIGS. 9 to 11. Further structural details of the burner assembly 1 are provided in FIG. 6 which schematically shows an exploded view of an exemplary embodiment of a combustor 100 including an exemplary embodiment of the pilot burner assembly 1 of the present technique. It may be noted that the burner assembly 1 and/or the combustor 100 generally may include more parts, and in FIG. 6 only those parts or components have been depicted that are important for understanding of the present technique.

The combustor 100 includes the pilot burner 30 having the burner face 33 (as explained hereinabove in reference to FIGS. 1 to 5 and FIGS. 9 to 11), the radial swirler 70 having swirler vanes 72, generally wedge shaped or pie-slice shaped, positioned on an annular base plate 71 around the burner face 33 for creating a swirling mix of a main-fuel and air, an annular closing plate 92 to which the swirler vanes 72 of the swirler 70 are attached and the combustion volume 28 defined by the combustion chamber 99, and optionally a transition piece referred to as the pre-chamber 88 located between the swirler 70 and combustion chamber 99. In general, the transition piece 88 or the pre-chamber 88 may be implemented as a one part continuation of the combustion chamber 99 towards the pilot burner 30, or as a separate part between the pilot burner 30 and the combustion chamber 99. The pilot burner 30, the swirler 70, the burner pre-chamber 88 and the combustion chamber 99 show substantially rotational symmetry about the longitudinally axis 35, i.e. the longitudinal axis 9 of the burner 30 coincides with the longitudinal axis 35 of the combustion volume 28. It may be noted that the longitudinal axis 9 and the longitudinal axis 35 have been shown separately in a non-overlapping representation for sake of understanding the alignment of the longitudinal axis 9 and the longitudinal axis 35.

In the swirler 70, a plurality, for example twelve, of the swirler vanes 72 are arranged circumferentially spaced around annular base plate 71 so as to form, between adjacent swirler vanes 72, slots 75. The annular base plate 71 includes at the radially outer end of each slot 75 a base injection holes 77 by means of which the main-fuel is supplied to the swirler 70. Each swirler vane 72 may additionally include at the radially outer end of a side 73 thereof one or more side injection holes 76 by means of which the main-fuel is also supplied to the swirler 70. The base injection holes 77 and the side injection holes 76 are depicted as the main-fuel injection holes 59 in FIGS. 2 to 5 and later in FIG. 12.

Figure 6:
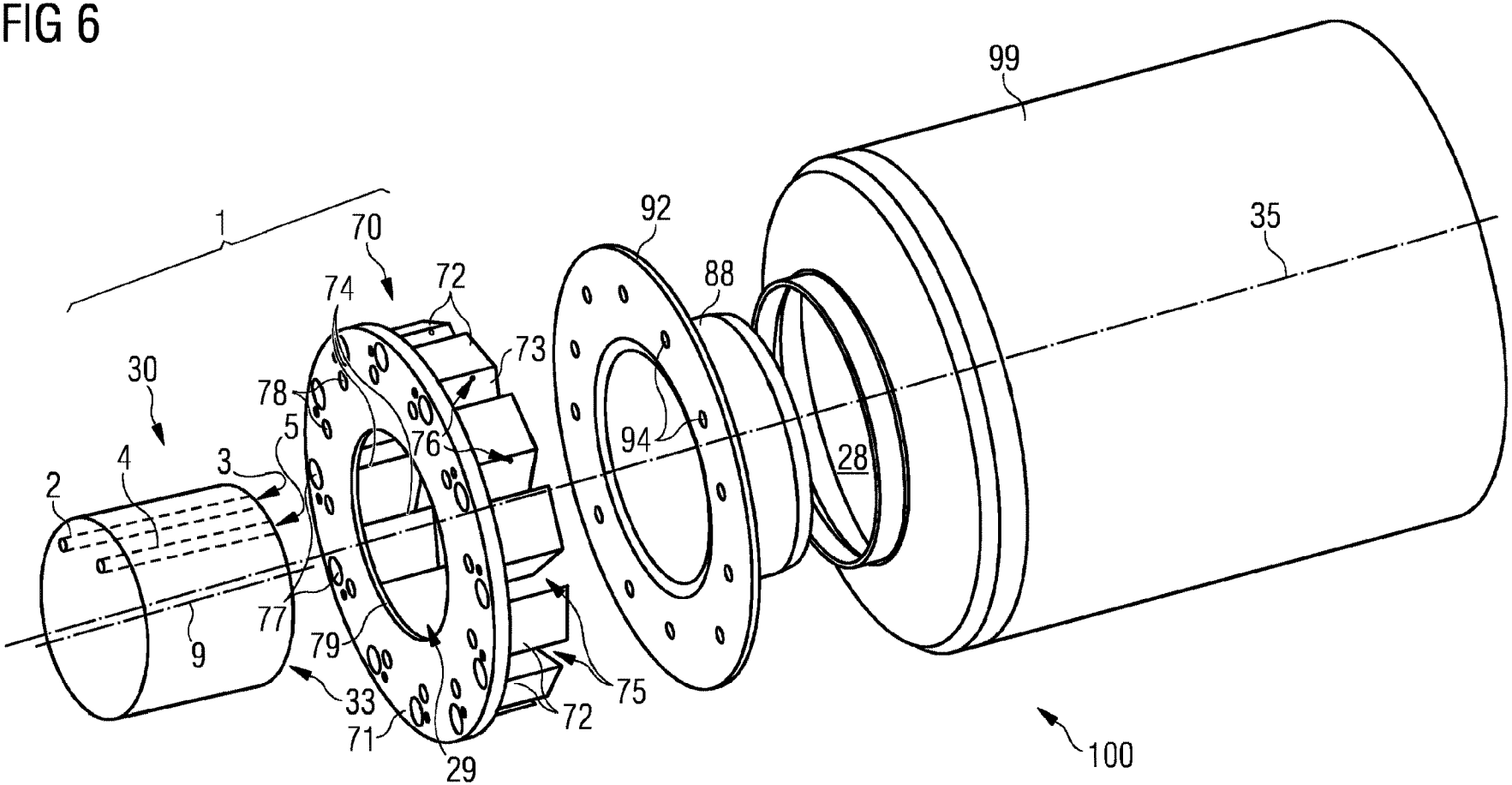
FIG. 6 schematically illustrates an exploded view of an exemplary embodiment of the pilot burner assembly of the present technique while showing other components of a combustor.

A plurality of fixing holes 78 extend through swirler vanes 72 and the annular base plate 71 through which the swirler vanes 72 are fixed on the annular base plate 71, as shown in FIG. 6. Alternatively, the swirler vanes 72 may be integrally formed, i.e. as one-part extension, with the annular base plate 71. Generally, the annular base plate 71 is fixed onto an adapter plate (not shown) positioned annularly around the burner face 33, however the swirler 70 along with the swirler vanes 72 may be positioned for the pilot burner assembly 1 by supporting the swirler 70 on other components (not shown). The annular base plate 71 has a radially inner edge 79 defining a centrally disposed inner opening 29 of the annular base plate 71. When the burner assembly 1 is assembled or integrated into the combustor 100, the burner face 33 fits into the inner opening 29 of the annular base plate 71.

Figure 7:
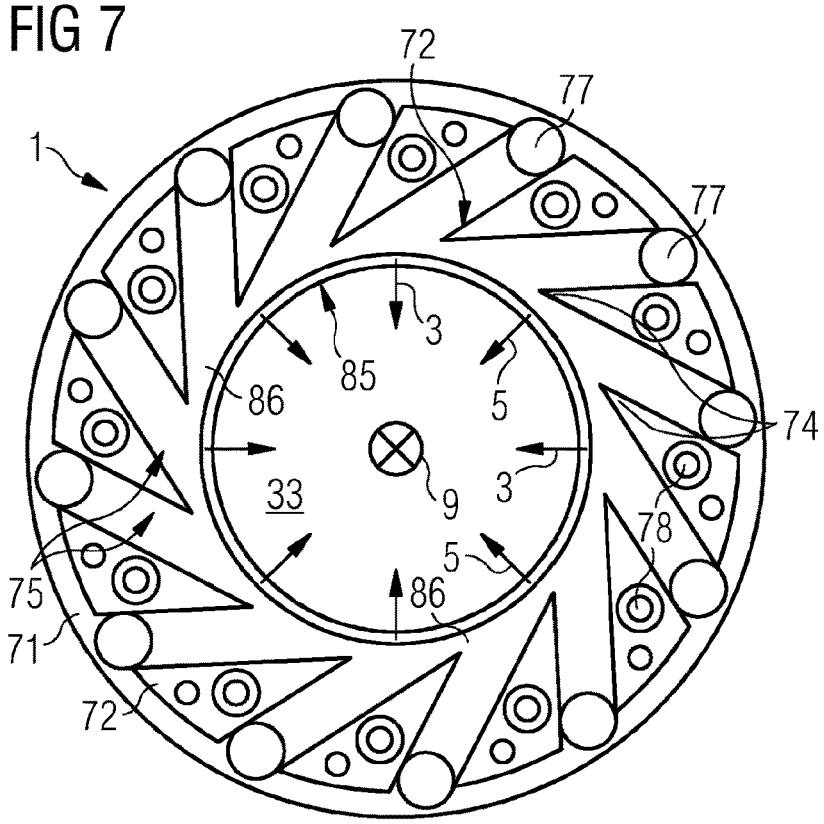
FIG. 7 schematically illustrates top view of an exemplary embodiment of the pilot burner assembly of FIG. 6 depicting a swirler.
Figure 8:
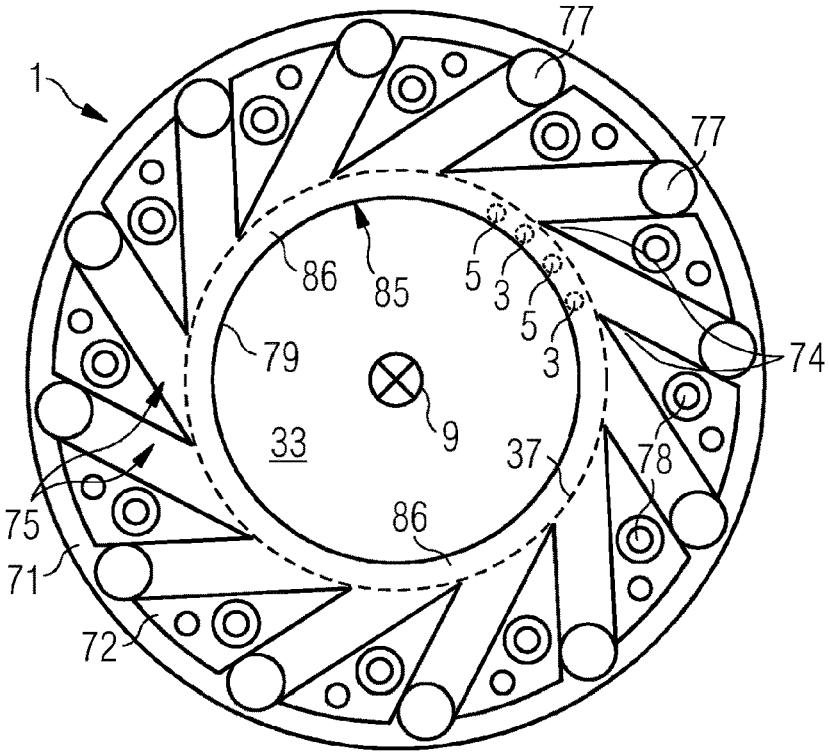
FIG. 8 schematically illustrates top view of another exemplary embodiment of the pilot burner assembly of FIG. 6 depicting the swirler.

As seen in FIGS. 7 and 8, each swirler vane 72 has a thin end 74 that has a radially inner position. As shown in FIG. 8, the radially inner thin ends 74 of swirler vanes 72 are set back from the radially inner edge 79 of the annular base plate 71 thereby to define an annular ledge 86 immediately radially outward of edge 79.

As shown in FIG. 6, the pre-chamber 88 is generally cylindrical in form and may be formed integrally with annular closing plate 92 or may be attached to the annular closing plate 92 through an intermediate component (not shown). Thus, on one face of the annular closing plate 92 the swirler vanes 72 are attached, through a plurality of fixing holes 94 included in the annular closing plate 92 aligned with the fixing holes 78 of the swirler vanes 72 by using nuts and bolts (not shown), and on the other face of the annular closing plate 92 the pre-chamber 88 is integrally formed or is attached through an intermediate piece (not shown). It may be noted that the assembly of the swirler 70, the swirler vanes 72, the annular closing plate 92 and the pre-chamber 88 shown in FIG. 6 are for exemplary purposes only and that there may be other pieces or components, such as other annular plates (not shown) that connect one component to another, for example the swirler vanes 72 may be connected or integrally formed with a top plate (not shown) which may then be connected to the annular closing plate 92.

The air, i.e. the air that is mixed with the main-fuel is supplied to the radially outer ends of slots 75 of the swirler 70 and travels generally radially inwardly along slots 75 confined between two adjacent swirler vanes 72 on the sides, the base plate 71 at the bottom, and the face of the annular closing plate 92 facing the swirler vanes 72. The main-fuel is supplied to base injection holes 77, and optionally to the side injection holes 76 opening in the slots 75, so as to enter slots 75 and mix with the air, referred to as the swirler air in the present disclosure, travelling along slots 75. Thus, the swirler 70 creates a swirling mix of main-fuel and air in an annular region immediately radially inward of the radially inner ends of slots 75. This swirling mix travels axially along the combustor 100 to combustion chamber 99, passing through the annular closing plate 92, and the pre-chamber 88.

Referring now to FIGS. 9 to 11 in combination with FIGS. 7 and 8, alternate exemplary embodiments of the burner assembly 1 have been explained. As shown in FIG. 7, the lip 85 may be formed from another component, other than the swirler 70, for example the aforementioned adapter plate (not shown) onto which the annular base plate 71 may be fixed. In FIG. 7, the arrows represented by reference numerals 3 and 5 represent locations of the pilot-fuel holes 3 and the pilot-air holes 5 present under the lip 85. The pilot-fuel holes 3 and the pilot-air holes 5 themselves have not been depicted in FIG. 7. However, as shown in FIG. 8, the lip 85 may be formed from the annular ledge 86 of the annular base plate 71 of the swirler 70. In FIG. 8, the edge 37 of the underlying burner face 33 and the alternately arranged pilot-fuel holes 3 and pilot-air holes 5 have been depicted with dashed line for purposes of understanding relative positioning of the pilot-fuel holes 3 and the pilot-air holes 5 with respect to the annular ledge 86 of the annular base plate 71.

Figure 12:
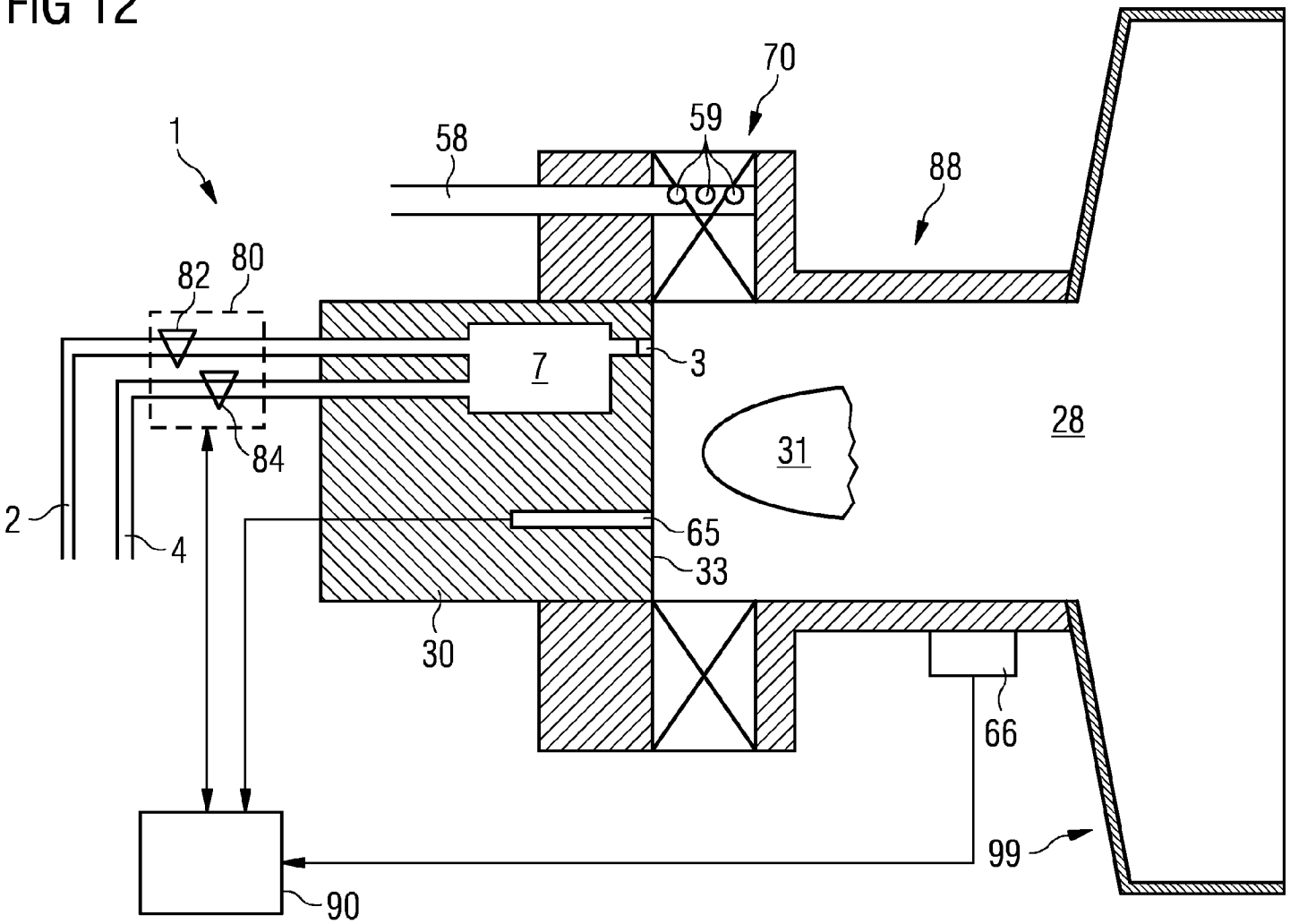
FIG. 12 schematically illustrates yet another exemplary embodiment of the pilot burner assembly of the present technique; in accordance with aspects of the present technique.

Now FIG. 12 has been referred to hereinafter to explain further embodiments of the burner assembly 1. Parts of FIG. 12 use the representation of FIG. 4 for exemplary purposes only. The burner assembly 1 besides the burner 30 having the burner surface 33, the combustion volume 28, the pilot-fuel supply line 2 for providing the pilot-fuel to the burner 30, the pilot-air supply line 3 for providing the pilot-air to the burner 30, also includes a pilot-air valve 84 for controlling a flow of the pilot-air in the pilot-air supply line 4 towards the pilot burner 30. The pilot-air valve 84 may be part of a valve unit 80. The burner assembly 1 may further include one or more of a temperature sensor 65, a pressure sensor 66 and a control unit 90. The control unit 90 directs or instructs the pilot-air valve 84 to control the flow of the pilot-air in the pilot-air supply line 4 towards the pilot burner 30 such that the pilot-fuel and the pilot-air are provided to the combustion volume 28 in a desired ratio of the pilot-fuel and the pilot-air. It may be noted that albeit FIG. 12 has been shown as an example to correspond to the embodiment of FIG. 4, further description of FIG. 12 provided herein is equally applicable to the embodiments of FIG. 3 and FIG. 5.

The pilot-air valve 84 may be a part of the valve unit 80, which in turn may additionally include a pilot-fuel valve 82. The valve unit 80 functions to vary a ratio of the pilot-fuel and the pilot-air provided to the burner 30 via the pilot-fuel supply line 2 and the pilot-air supply line 4, respectively, by initiating, changing or stopping supply of one or both of the pilot-fuel and the pilot-air provided to the burner 30 via the pilot-fuel supply line 2 and the pilot-air supply line 4. The pilot-fuel valve 82 controls the flow of the pilot-fuel into the premixing chamber 7, and therefore to the combustion volume 28 (or directly to the combustion volume 28 in the embodiment of FIG. 5). The pilot-air valve 84 controls flow of the pilot-air into the premixing chamber 7, and therefore to the combustion volume 28 (or directly to the combustion volume 28 in the embodiment of FIG. 5). The pilot-air valve 84, and optionally the valve unit 80, is controlled, i.e. instructed about the ratio of the pilot-fuel and the pilot-air, by instructions received from the control unit 90. The valve unit 80 furthermore reports an existing ratio to the control unit 90.

The temperature sensor 66 senses temperature of a part, for example, but not limited to, the burner face 33 of the burner 30. The temperature sensor 66 may be a thermocouple embedded into the burner 30 and which communicates a temperature signal to the control unit 90. The temperature signal thus received by the control unit 90 is indicative of the temperature so sensed of the part 33 i.e. the burner face 33. The pressure sensor 66 senses pressure information, for example, but not limited to, amplitude or frequency of pressure vibrations, representing a pressure at a location of the combustion volume 28. The location in the combustion volume 28 is depicted for exemplary purposes as a body of the pre-chamber 88. The pressure sensor 66 then communicates a pressure signal, to the control unit 90, indicative of the pressure at the location, i.e. of the pre-chamber 88 in example of FIG. 12, of the combustion volume 28. The positions of the temperature sensor 65 and the pressure sensor 66 depicted in FIG. 12 are for exemplary purposes only, and it may be appreciated by one skilled in the art of monitoring operating characteristics of combustors that the temperature sensor 65 and the pressure sensor 66 may be positioned in various other positions in the combustor 100.

The control unit 90 receives the temperature signal from the temperature sensor 65 and the pressure signal from the pressure sensor 66. The control unit 90, which may be but not limited to a data processor, a microprocessor, a programmable logic controller may be either a separate unit or a part of the engine control unit (not shown) that monitors or regulates one or more operating parameters of the gas turbine engine 10 of FIG. 1. The control unit 90, based on the temperature signal, instructs or directs the valve unit 80 and/or the pilot-air valve 84, through one or more output signals sent to the valve unit 80 and/or the pilot-air valve 84, for changing the ratio of the pilot-fuel and the pilot-air provided to the burner 30.

While the present technique has been described in detail with reference to certain embodiments, it should be appreciated that the present technique is not limited to those precise embodiments. It may be noted that, the use of the terms 'first', 'second', etc. does not denote any order of importance, but rather the terms 'first', 'second', etc. are used to distinguish one element from another. Rather, in view of the present disclosure which describes exemplary modes for practicing the invention, many modifications and variations would present themselves, to those skilled in the art without departing from the scope of this invention. The scope of the invention is, therefore, indicated by the following claims rather than by the foregoing description. All changes, modifications, and variations coming within the meaning and range of equivalency of the claims are to be considered within their scope.

The invention claimed is:

1. A pilot burner assembly for a combustion volume of a gas turbine engine, the pilot burner assembly comprising:

a pilot burner having a generally cylindrical body disposed about a longitudinal axis of the pilot burner and comprising a burner face disposed to face the combustion volume, the burner face having a plurality of pilot-fuel injection holes adapted to provide a pilot-fuel to the combustion volume for combustion;

a first fuel supply line being a pilot-fuel supply line fluidly connected to the plurality of the pilot-fuel injection holes and adapted to provide the pilot-fuel to the plurality of the pilot-fuel injection holes;

a pilot-air supply line adapted to provide a pilot-air to the pilot burner and wherein the pilot-air is supplied to the combustion volume through the burner face; and a premixing chamber, wherein the premixing chamber is fluidly connected to the pilot-fuel supply line to receive the pilot-fuel, and is further fluidly connected to the pilot-air supply line to receive the pilot-air, wherein the premixing chamber is arranged to form a pilot mixture of pilot-fuel/pilot-air premix within the premixing chamber before the pilot mixture is supplied to the combustion volume and wherein the premixing chamber has an outlet fluidly connected to the plurality of the pilot-fuel injection holes to provide the pilot-fuel/pilot-air premix to the combustion volume for combustion, a second fuel supply line to supply a main-fuel to a main swirler to generate a main mixture of main-fuel/main-air arranged to enter the combustion volume through the swirler, wherein the pilot mixture of pilot-fuel/pilot-air formed within the premixing chamber is formed separate from the main mixture of main-fuel/main-air generated by the swirler, wherein the outlet of the premixing chamber is defined by a conduit extending between the premixing chamber and the burner face, wherein the premixing chamber is in the body of the pilot burner, and wherein the pilot mixture of the pilot-fuel/pilot-air premix is conveyed by way of the conduit to be ejected from the plurality of pilot-fuel injection holes in the burner face into the combustion volume, wherein the pilot mixture of the pilot-fuel/pilot-air premix being ejected from the plurality of pilot-fuel holes is arranged to mix with the main mixture of main-fuel/main-air entering through the main swirler to form a combined mixture of the pilot mixture and the main mixture in the combustion volume.

2. The pilot burner assembly according to claim 1, wherein the pilot-air supply line is fluidly connected to the pilot-fuel supply line for providing the pilot-air into the pilot-fuel supply line to form a pilot-fuel/pilot-air premix within the pilot-fuel supply line, and wherein the plurality of the pilot-fuel injection holes are adapted to provide the pilot-fuel/pilot-air premix to the combustion volume for combustion.

3. The pilot burner assembly according to claim 1, wherein the burner face comprises a plurality of pilot-air injection holes fluidly connected to the pilot-air supply line and adapted to provide the pilot-air to the combustion volume.

4. The pilot burner assembly according to claim 3, wherein the plurality of the pilot-fuel injection holes are arranged on the burner face circumferentially around a longitudinal axis of the pilot burner, and wherein the plurality of the pilot-air injection holes are arranged circumferentially around the longitudinal axis.

5. The pilot burner assembly according to claim 4, wherein the plurality of the pilot-fuel injection holes and the plurality of the pilot-air injection holes are congruently arranged around the longitudinal axis and wherein the plurality of the pilot-fuel injection holes and the plurality of the pilot-air injection holes are alternately placed on the burner face.

6. The pilot burner assembly according to claim 4, wherein the pilot burner assembly comprises a lip overhanging axially above an annular region of the burner face such that an annular pocket is formed axially between the burner face and the lip, wherein the annular region of the burner face is positioned radially outward with respect to the longitudinal axis and wherein the pilot-fuel injection holes and the plurality of the pilot-air injection holes are positioned within the annular region of the burner face.

7. The pilot burner assembly according to claim 6, further comprising:

a radial swirler adapted to generate a swirling mix of a main-fuel and air entering the combustion volume through the main swirler, the radial swirler comprising:

an annular base plate having a radially inner edge; and a plurality of swirler vanes disposed on the annular base plate arranged circumferentially spaced apart and extending radially around the longitudinal axis of the pilot burner, wherein the swirler vanes include radially inner thin ends and wherein the radially inner thin ends are set back from the radially inner edge of the annular base plate thereby to define an annular ledge on the annular base plate immediately radially outward of the radially inner edge of the annular base plate; and wherein the lip is formed of the annular ledge of the annular base plate.

8. The pilot burner assembly according to claim 3, wherein a size of the plurality of the pilot-air injection holes is smaller than a size of the plurality of the pilot-fuel injection holes.

9. The pilot burner assembly according to claim 1, further comprising: a pilot-air valve adapted to control a flow of the pilot-air in the pilot-air supply line towards the pilot burner.

10. The pilot burner assembly according to claim 9, further comprising: a control unit adapted to direct the pilot-air valve to control the flow of the pilot-air in the pilot-air supply line towards the pilot burner such that the pilot-fuel and the pilot-air are provided to the combustion volume in a desired ratio of the pilot-fuel and the pilot-air.

11. A gas turbine engine comprising:

at least one pilot burner assembly, the at least one pilot burner assembly according to claim 1.

12. A gas turbine engine according to claim 11 wherein the main swirler is a radial swirler comprising an annular array of swirler vanes arranged circumferentially spaced around an annular base plate so as to form, between adjacent swirler vanes, slots, wherein the pilot burner assembly is generally surrounded by the radial swirler.

* * * * *